US010119799B2

(12) United States Patent
Kuchman

(10) Patent No.: US 10,119,799 B2
(45) Date of Patent: Nov. 6, 2018

(54) TOKEN SYSTEM FOR USE WITH DEDICATED ROUNDS OF AMMUNITION

(71) Applicant: AMTEC Less Lethal Systems, Inc., Perry, FL (US)

(72) Inventor: Todd Kuchman, Greeley, CO (US)

(73) Assignee: AMTEC Less Lethal Systems, Inc., Perry, FL (US)

( * ) Notice: Subject to any disclaimer, the term of this patent is extended or adjusted under 35 U.S.C. 154(b) by 0 days.

(21) Appl. No.: 15/590,541

(22) Filed: May 9, 2017

(65) Prior Publication Data

US 2017/0322004 A1 Nov. 9, 2017

Related U.S. Application Data

(60) Provisional application No. 62/333,349, filed on May 9, 2016.

(51) Int. Cl.

| | |
|---|---|
| ***F24B 7/02*** | (2006.01) |
| ***F42B 5/34*** | (2006.01) |
| ***F42B 8/02*** | (2006.01) |
| ***F42C 19/04*** | (2006.01) |
| ***F42C 19/08*** | (2006.01) |
| ***F42B 7/02*** | (2006.01) |
| ***F41A 17/44*** | (2006.01) |
| ***F42B 5/26*** | (2006.01) |

(52) U.S. Cl.

CPC ..... *F42C 19/083* (2013.01); *F41A 17/44* (2013.01); *F42B 5/26* (2013.01); *F42B 5/34* (2013.01); *F42B 7/02* (2013.01); *F42C 19/04* (2013.01); *F42B 8/02* (2013.01)

(58) Field of Classification Search

CPC ..... F42B 5/00; F42B 5/02; F42B 5/26; F42B 5/28; F42B 5/34; F42B 5/285; F42B 5/30; F42B 5/307; F42B 7/00; F42B 7/02; F42B 8/00; F42B 8/02; F42B 8/04; F42B 8/06; F41A 17/00; F41A 17/44; F42C 19/04; F42C 19/083; F42C 19/08

USPC ..... 102/444, 446, 469, 470; 42/41, 70.01

See application file for complete search history.

(56) References Cited

U.S. PATENT DOCUMENTS

| | | | | |
|---|---|---|---|---|
| 2,655,755 | A * | 10/1953 | Nichols | F41C 3/10 102/441 |
| 3,237,335 | A * | 3/1966 | Kerr | F41A 19/41 102/444 |
| 6,612,063 | B1 * | 9/2003 | Sigg | F41A 3/12 102/430 |
| 8,484,876 | B2 * | 7/2013 | Mossberg | F41A 9/54 42/70.01 |
| 8,707,867 | B2 * | 4/2014 | Uhr | F41G 3/2655 102/444 |
| 8,782,938 | B2 * | 7/2014 | Teach, Jr. | F41A 3/58 42/41 |
| 9,927,191 | B2 * | 3/2018 | Teach | F41A 3/58 |

(Continued)

*Primary Examiner* — James S Bergin
(74) *Attorney, Agent, or Firm* — J. Wiley Horton

(57) ABSTRACT

A firearm cartridge with a specially-configured token disc added to its base. The token includes an outer section and a central strike plate. The strike plate includes a strike ball at its center. The presence of the token increases the effective length of the cartridge and thereby prevents the closure of the bolt of a conventional firearm. As a result, the inventive cartridge cannot be fired in a conventional firearm.

20 Claims, 14 Drawing Sheets

(56) References Cited

U.S. PATENT DOCUMENTS

| | | | | |
|---|---|---|---|---|
| 2009/0229484 | A1* | 9/2009 | Flynn | F41A 17/00 102/430 |
| 2016/0305729 | A1* | 10/2016 | Martin | F41A 17/64 |
| 2018/0017348 | A1* | 1/2018 | Brown | F41A 3/12 |

* cited by examiner

TOKEN SYSTEM FOR USE WITH DEDICATED ROUNDS OF AMMUNITION

CROSS-REFERENCES TO RELATED APPLICATIONS

Pursuant to 37 C.F.R. § 1.53(c), this non-provisional patent application claims the benefit of an earlier-filed provisional application. The provisional application was assigned Ser. No. 62/333,349. It was filed on May 9, 2016 and it listed the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

The invention relates to the field of firearms. More specifically, the invention comprises a token that is affixed to the base of a cartridge so that the modified cartridge can only be fired in a specially-configured firearm.

2. Description of Related Art

The present invention provides a firearm cartridge that is configured to be fired only in a specially-modified firearm. Such an invention is preferably adapted for use in a wide variety of firearms, including centerfire shotguns, rifles, and pistols. The invention may also be used with many other devices that use an explosive charge to launch a projectile, including less-lethal/non-lethal weapon systems (such as systems used for crowd control). The invention is particularly suited for use with firearms in which a bolt is moved in a direction that is parallel to the weapon's barrel bore. In such a firearm the round is loaded by the bolt moving forward (as opposed to break-action designs). Such bolts are found in pump-action shotguns, semi-automatic shotguns, slide-action rifles, bolt-action rifles, semi-automatic/automatic rifles, and semi-automatic/automatic pistols. The illustrations in this disclosure focus on pump-action shotguns, as this type of weapon is widely used in the law-enforcement community. However, the reader should bear in mind that the invention may be used in other types of weapons and non-weapon launchers as well.

In some cases a firearm's, bolt may combine both linear and rotary motion. As those skilled in the art will know, bolt-action rifles based on the inventions of Paul Mauser (such as the "Mauser '98") employ a linear motion to load the cartridge and a rotary motion to lock the breech closed. An invention in this field preferably accounts for this type of combined motion as well.

FIG. 1 depicts a bolt assembly from a pump-action shotgun. This specific example comes from a Remington Model 870. Bolt assembly 8 includes breech bolt 10, locking toggle 12, extractor 20 and other components (such as a firing pin and firing pin spring). Bolt face 16 bears against the base of a cartridge that is loaded in the weapon. The bolt face includes firing pin aperture 18. The firing pin itself is housed internally. It normally rests in a retracted position and therefore is not visible from the vantage point shown in FIG. 1. However, when the firing pin is struck by the weapon's hammer, the nose of the firing pin is propelled forward through firing pin aperture 18 to strike the primer on a cartridge.

As those skilled in the art will know, breech bolt 10 must be locked in the closed position before the weapon can be fired (It is true that some weapons fire from an open bolt, but this is the exception and such a configuration is not shown in the views). Locking toggle passage 14 passes through breech bolt 10 from top to bottom. Locking toggle 12 resides in this passage. Locking toggle 12 is employed to secure breach bolt 10 in the closed position and to perform other functions.

Extractor 20 is also connected to breech bolt 10. This claw-like component engages the rim on the base of a cartridge and pulls the cartridge out of the firing chamber when the bolt is moved rearward toward the open position. Other conventional features are also included in the bolt assembly. As these are well understood by those skilled in the art, they have not been depicted or described in more detail.

FIG. 4 depicts a prior art shotgun shell 32. Metallic shot is typically contained within a shot cup in hull 34. Head 38 is traditionally brass but is now more commonly made of steel (with a thin brass plating to preserve a traditional appearance). Head 38 includes base 40 and rim 42. Primer 36 is located in the center of base 40. The primer is a percussion-initiated device. When the shell is chambered in a shotgun, the striking of the primer by the firing pin fires the shell.

FIG. 5 shows a sectional view through the shotgun shell of FIG. 4. The hull is now commonly made of molded plastic. In the version shown, hull wall 46 and base wad 44 are molded as one integral piece. Head 38, base 40, and rim 42 are created by deforming one piece of metal. This metallic piece is deformed around the molded polymer of base wad 44 (or in some instances the metallic portion is placed into an injection molding machine and the plastic portion is injected into the metal portion). The same metallic piece is often deformed into primer pocket 48 (which also extends into the base wad). Primer 36 is pressed into primer pocket 48. The primer is typically retained by friction, although sealing lacquer placed over the all end of the assembly may also assist in the retention of the primer.

Propellant 50 is retained within wall 46 forward of the base wad. As those skilled in the art will know, when a firing pin strikes primer 36 the primer shoots burning gas into propellant 50 and ignites the shell. The burning propellant then forces the shot cup and shot down the bore and out of the weapon.

The shotgun shell construction shown in FIGS. 4 and 5 is one example among many different types in use. Older shells use waxed paper for the hull and brass for the base wad. Newer shells use injection-molded plastic for the hull and the head. In fact, the use of metal for the head portion of the shell in modem designs is largely a nod to tradition. The metallic portion in many instances is a decorative overlay, with the molded plastic base wad providing most of the required structural integrity.

Centerfire firearm cartridges (such as shotgun shells) have traditionally been thought of as a "lethal force" device, meaning that they possess the ability to kill a human or animal target. Even when smaller shot sizes are used (#7 and higher) a shotgun shell has the capacity to kill at close range. Now, however, non-lethal, and "less-lethal" cartridges have been developed for crowd control and other purposes. As an example, some shotgun, shells employ soft projectiles and other means to deliver a stunning blow without the potential for the creation of a fatal wound. These cartridges may be generally referred to as "less-lethal cartridges."

Less-lethal cartridges are currently fired from the same firearms used for lethal cartridges and this fact has created unintended results. In a situation where an individual or crowd of individuals must be engaged and subdued, police officers are acting quickly and in a heightened emotional state. In such a situation it is possible for an officer to accidentally load a lethal shotgun cartridge instead of the less-lethal cartridge he or she intended to load. The mistake may not be discovered until the weapon is fired.

It is desirable to provide a cartridge and weapon system for delivering a less-lethal/non-lethal blow that prevents the accidental use of a lethal cartridge. The present invention provides such a solution.

BRIEF SUMMARY OF THE INVENTION

The present invention comprises a firearm cartridge with a specially-configured token disc added to its base. The token includes an outer section and a central strike plate. The strike plate includes a strike ball at its center. The presence of the token increases the effective length of the cartridge and thereby prevents the closure of the bolt of a conventional firearm. As a result, the inventive cartridge cannot be fired in a conventional firearm.

A conventional firearm may be modified to fire the inventive cartridge by relieving a substantial part of the bolt face so that the bolt face receives the token disc. The firing pin of such a modified firearm must also be shortened. As a result, a firearm modified to use the inventive cartridge cannot fire a conventional cartridge. The result is a cartridge which can only be fired in a modified firearm, and a modified firearm which can only fire the inventive cartridge.

REFERENCE NUMERALS IN THE DRAWINGS

Figure 1:
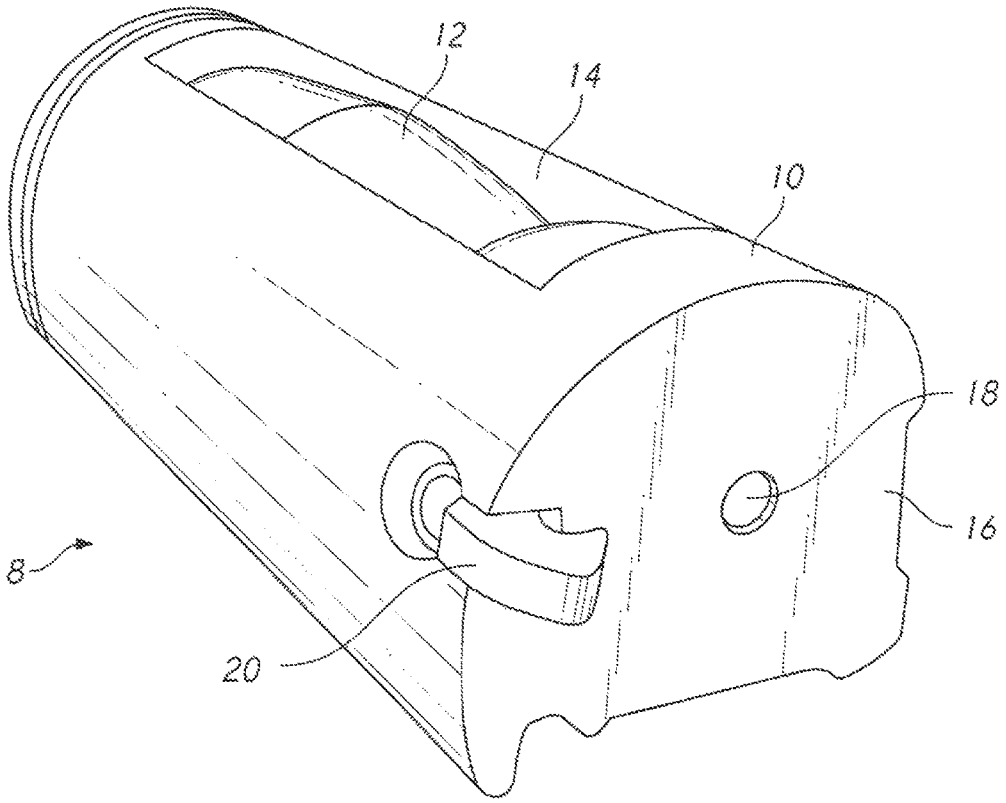
FIG. 1 (PRIOR ART)
FIG. 1 is a perspective view, showing a prior art shotgun bolt assembly.

8 bolt assembly
10 breech bolt
12 locking toggle
14 locking toggle passage
16 bolt face
18 firing pin aperture
20 extractor
21 follower
24 firing pin
25 nose
26 flange
27 normal position
28 compression spring
30 counterbore
32 shotgun shell
34 hull
36 primer
38 head
40 base
42 rim
44 base wad
46 wall
48 primer pocket
50 propellant
54 barrel
60 barrel extension
62 receiver
90 recessed bolt face
92 token disc
94 strike plate
96 strike ball
98 arm
100 first hinge relief
102 second hinge relief
104 cut-out
106 outer section
108 passage
110 overhang
112 slot
114 receiver pin

DETAILED DESCRIPTION OF THE INVENTION

The present invention may be adapted for use in a wide variety of centerfire firearms. It is particularly suited to those firearms having a linearly reciprocating breech bolt. Thus, it could be applied to pump shotguns, semi-automatic/automatic shotguns, semi-automatic/automatic pistols, slide-action rifles, straight-pull rifles (such as the Blaser), semi-automatic/automatic rifles, and Mauser-type bolt rifles—among other types. Exemplary shotgun applications include the Remington 870 pump shotgun, the Remington 1100-series semi-automatic shotguns, the Winchester SXP pump shotgun, the Browning Auto 5 semi-automatic shotgun, the Mossberg 500, and the Benelli Black Eagle-series shotguns. Because the Remington 870 is widely used in law enforcement, it is used in the attached illustrations. However, those skilled in the art will readily appreciate how the invention could be applied to many other firearm models and types.

Figure 2:
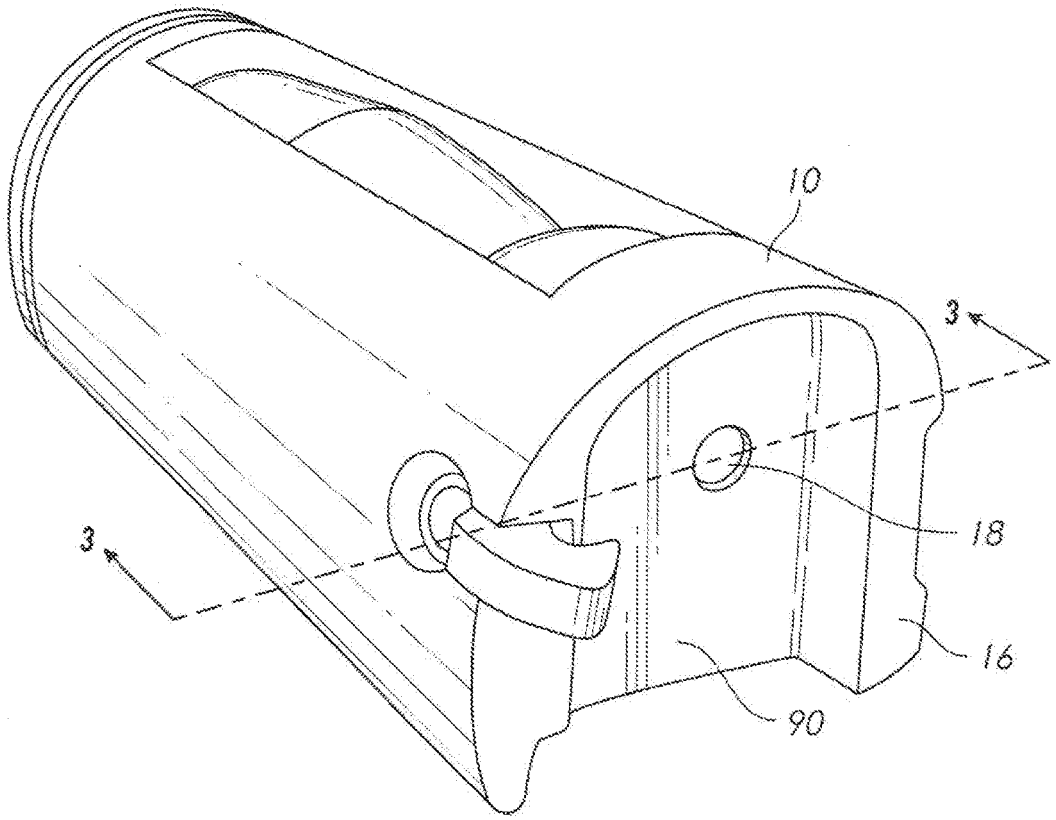
FIG. 2 is a perspective view, showing a shotgun bolt assembly modified according to the present invention.

As explained previously, FIG. 1 shows a prior art bolt assembly 8 such as used in the Remington Model 870 shotgun. FIG. 2 shows the same bolt assembly modified according to the present invention. A portion of bolt face 16 is relieved to create recessed bolt face 90. A bolt is typically manufactured by finish machining a forging. The overall thickness of the bolt face itself may need to be increased to accommodate the relieved portion. However, for the relatively mild pressures associated with shotguns, most bolts have considerably more thickness around the bolt face than is needed. It may therefore be possible to simply machine away some of the thickness of the bolt face without modifying the forging.

In any event the finished result preferably looks like FIG. 2. In the embodiment shown, a portion of the original bolt face is left along the left side of the bolt. A portion of the original bolt face also remains along the rights side of the bolt proximate the extractor. Throughout this disclosure, the reader should bear in mind that directional terms such as left, right, forward, and rearward are referring to the viewpoint of a user holding a firearm in a customary firing position (with the firearm's barrel in a horizontal orientation). Many firearms are "handed," meaning that they are configured for a right-handed or left-handed shooter. The bolt shown in FIGS. 1 and 2 is from a shotgun configured for use by a right-handed shooter. The loading port on such a weapon is on the right side of the receiver and thus the extractor is on the right side of the bolt.

Figure 3:
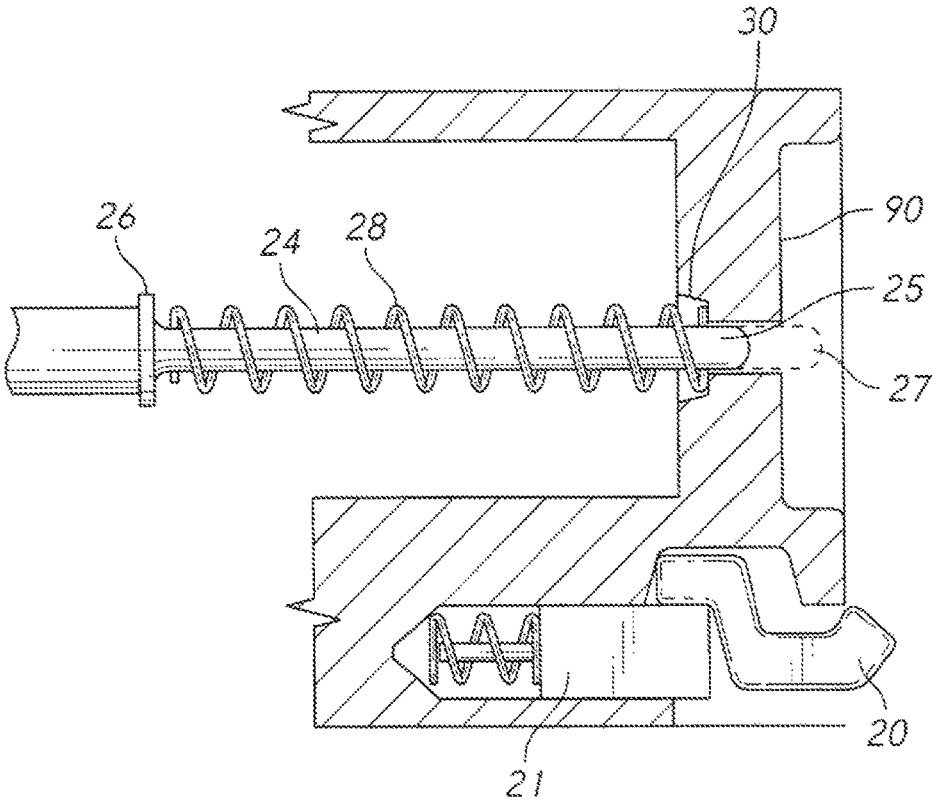
FIG. 3 is a sectional top view of the inventive bolt assembly.
Figure 4:
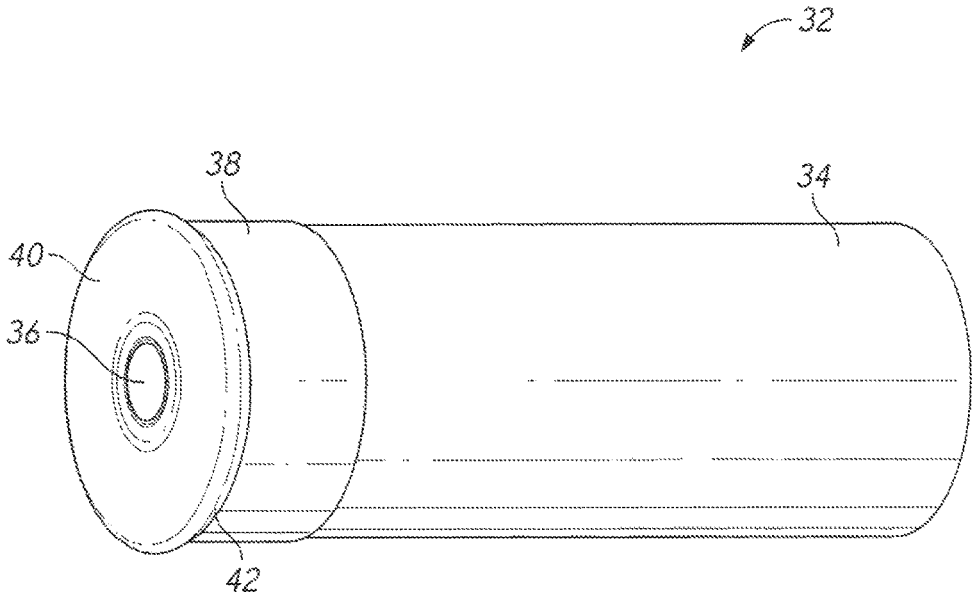
FIG. 4 (PRIOR ART)
FIG. 4 is a perspective view, showing a prior art shotgun shell.
Figure 5:
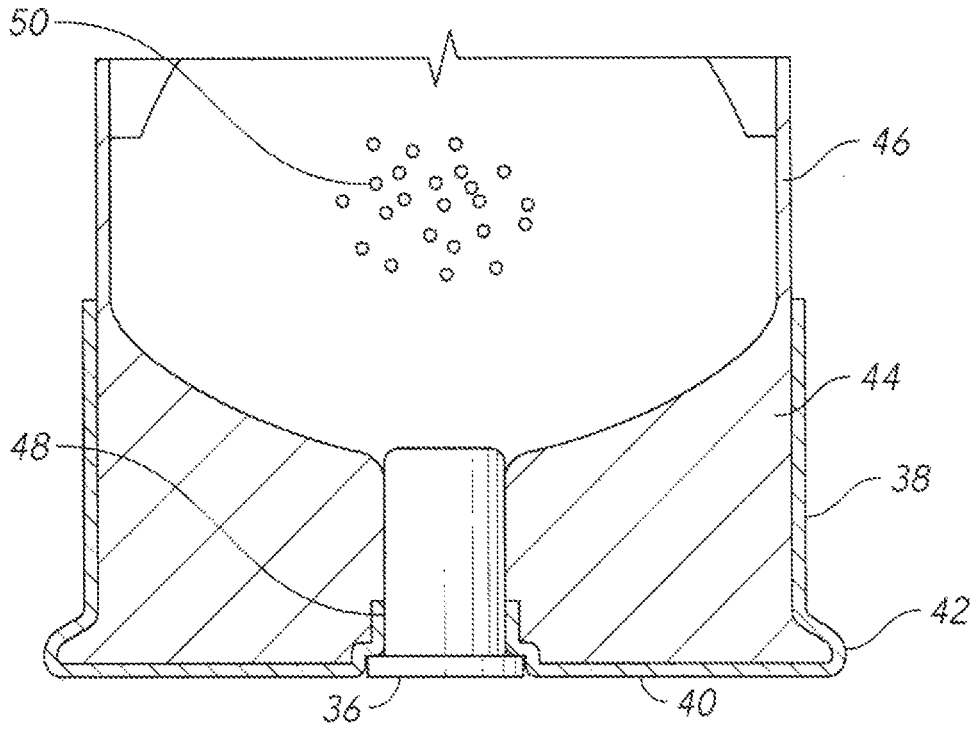
FIG. 5 (PRIOR ART)
FIG. 5 is a sectional elevation view, showing some internal details of the prior art shotgun shell.

FIG. 3 shows a sectional top view taken through the mid-plane of the bolt assembly. Firing pin 24 rests within the bolt assembly, with the nose of the firing pin being recessed within firing pin aperture 18. Compression spring 28 is a coil spring located over the forward portion of the firing pin. It is compressed between flange 26 and counterbore 30. The rear portion of the firing pin (not shown) is engaged by a journal in the breech bolt and thereby prevented from exiting the breech bolt. Compression spring 28 remains in compression even when the firing pin is in a resting state (as shown) thereby ensuring that the nose of the firing pin remains behind the bolt face. When the trigger is pulled and the rear portion of the firing pin is struck by the shotgun's hammer, the nose of the firing pin is forced beyond the bolt face and it will then strike the primer of a cartridge that is present in the firing chamber. The compression spring then urges the firing pin back toward the retracted position shown. This type of arrangement is sometimes referred to as a "rebounding" firing pin action. It is present in the vast majority of modern firearms. Extractor 20 is held in position by the compression spring acting on follower 21. The "claw" portion of the extractor is configured to slip over and engage the flange (sometimes called a "rim") on the base of a shotgun shell. The reader wishing to further understand these prior art mechanisms is referred to U.S. Pat. No. 2,645,873—which pertains to the Remington Model 870 shotgun.

In FIG. 3, the reader will again note that a portion of the bolt face has been relieved to produce recessed bolt face 90. Normal position 27 (shown in dashed lines) represents the normal forward extent of an unmodified firing pin. In the present invention, the firing pin is shortened. Nose 25 of this modified firing pin thus resides behind recessed bolt face 90 in its resting state. An unmodified firing pin would protrude to the position indicated by the dashed line.

Figure 6:
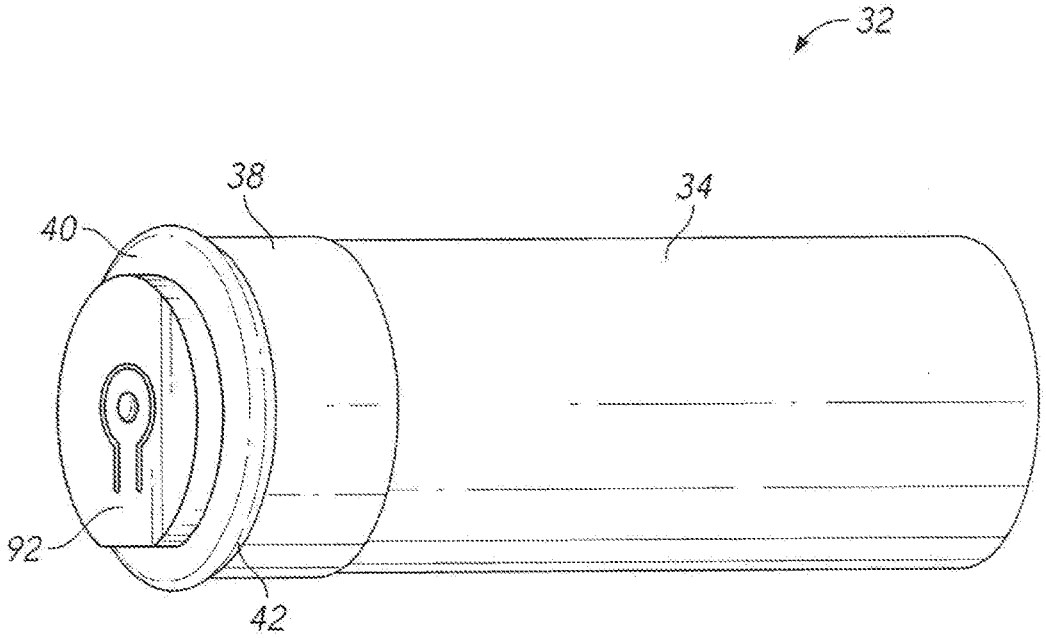
FIG. 6 is a perspective view, showing a shotgun shell modified according to the present invention.

The modified breech bolt of FIG. 3 requires a modified shotgun cartridge in order for the bolt assembly to close, lock, and fire. FIG. 6 shows an example of such a modified cartridge. Its general construction is the same as for the prior art cartridge described previously. It includes a hull and a head. Base 40 is modified, however, by the addition of token disc 92. Token disc 92 is affixed to the base of the shell using a suitable adhesive. It then becomes part of the shotgun shell. Using this approach, the token disc and the conventional shotgun shell may be united at the time of original manufacturing. On the other hand, existing shotgun shells may be modified into the inventive shotgun shell by adding the token disc. The result is the same.

Figure 7:
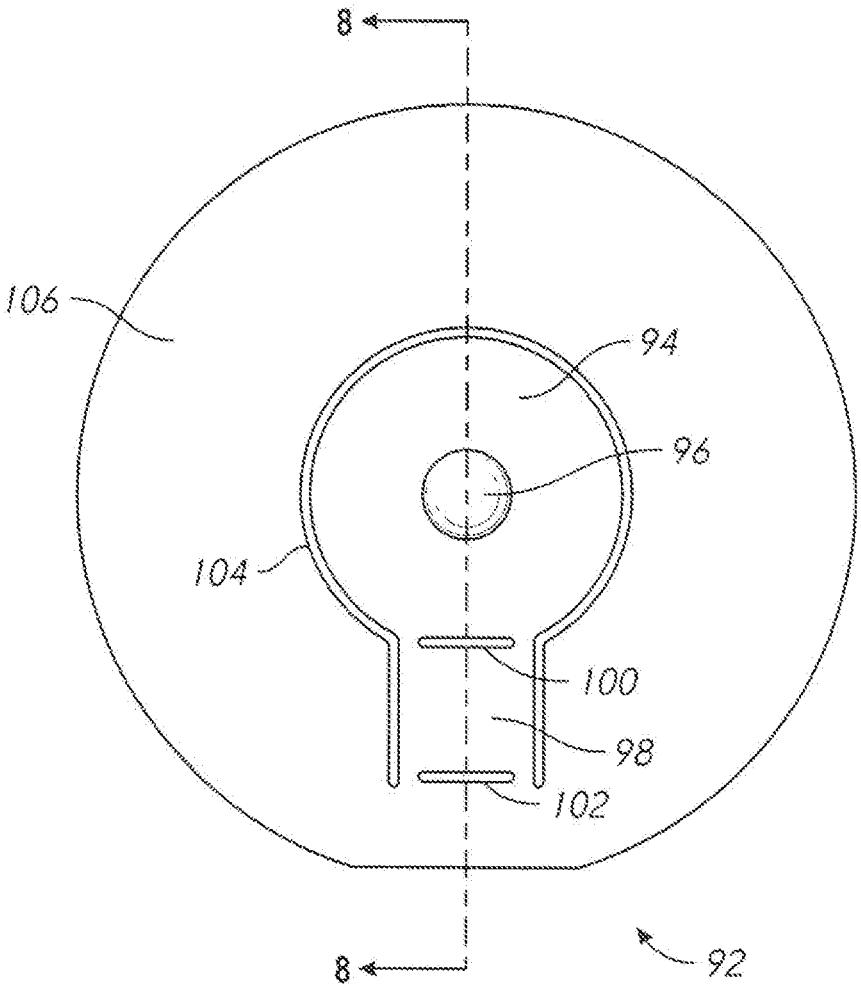
FIG. 7 is an elevation view, showing the inventive token disc.

FIG. 7 shows a plan view of token disc 92. The disc is preferably circular and made as one integral piece. Strike plate 94 is situated in the center. The strike plate is separated from outer section 106 by cut-out 104—a channel which extends all the way through the material. Arm 98 connects strike plate 94 to the surrounding outer section 106.

Strike ball 96 is mounted in the center of strike plate 94. In operation, the strike ball will be struck by the nose of the modified firing pin and the strike ball will then be propelled into the primer to detonate the cartridge. It is preferable for the strike plate and arm to pivot relative to outer section 106. First hinge relief 100 and second hinge relief 102 are provided to facilitate this motion. The hinge reliefs are simply recesses in the material that extend partly through the material. They allow the material to flex more easily.

Figure 8:
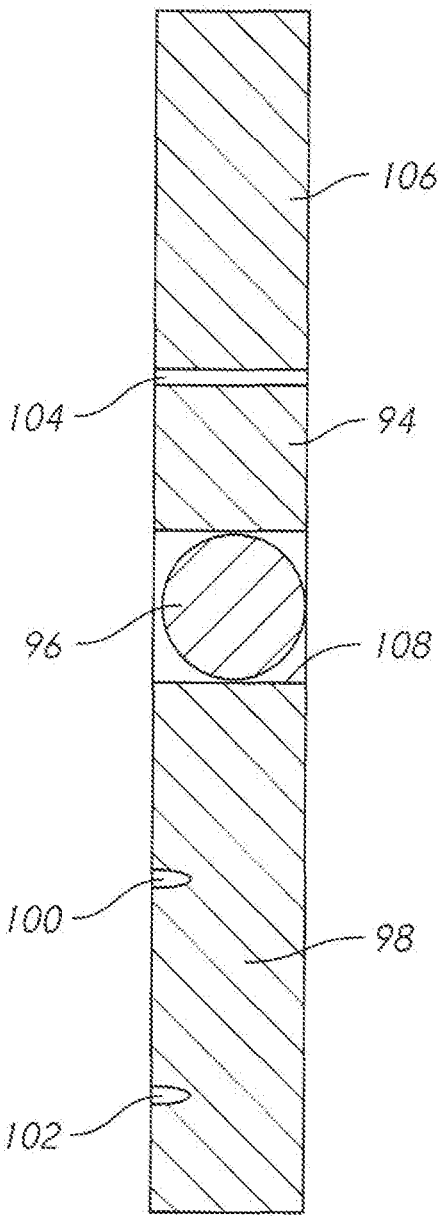
FIG. 8 is a sectional elevation view, showing some internal details of the token disc of FIG. 7.

FIG. 8 shows a sectional elevation view through the token disc. The reader will note how cut-out 104 extends all the way through the material whereas first and second hinge reliefs 100, 102 extend only partially. Strike ball 96 is contained within passage 108 in strike plate 94. The strike ball is preferably retained by a press fit. The passage may be a cylindrical hole with a diameter slightly less than the diameter of the strike ball. The passage may also be made with a non-circular cross-section so that multiple point contacts result with the spherical shape of the strike ball. As an example, passage 108 might be given a hexagonal cross section with the clearance between opposing facets being slightly less than the diameter of the strike ball.

The strike ball is preferably made of a hard metal such as steel. The surrounding strike plate, outer section, and arm are preferably made as a single integral piece. These portions may be made as a die casting of aluminum or brass. They may also be formed as an injection molded polymer.

Figure 9:
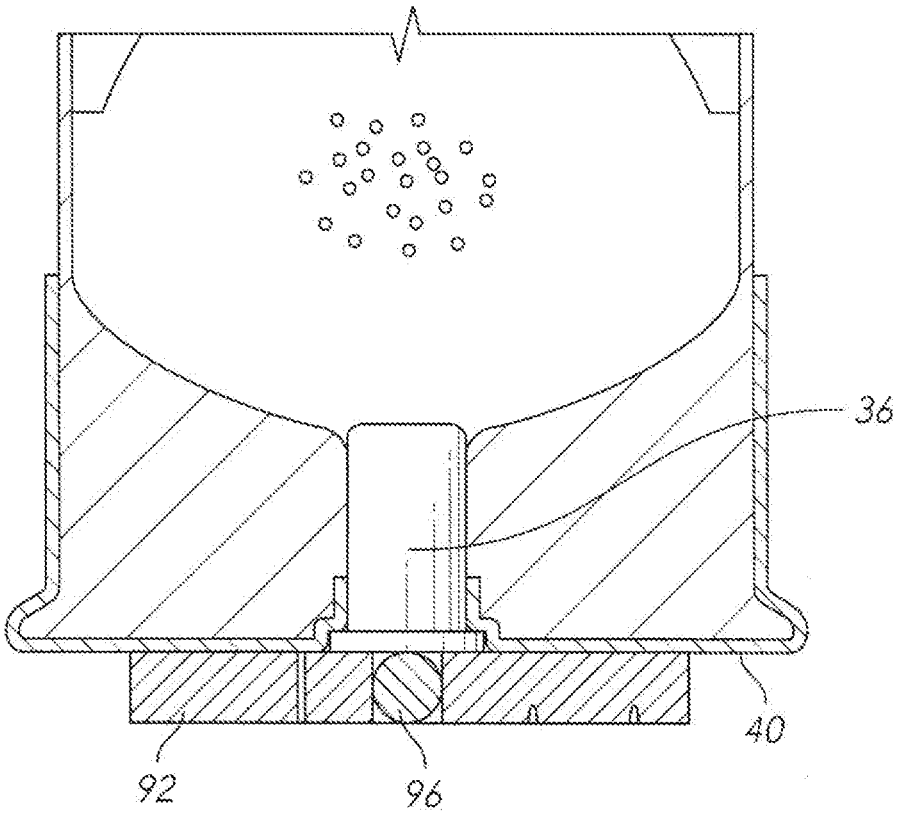
FIG. 9 is a sectional elevation view, showing the inventive token disc attached to a prior art shotgun shell.
Figure 10:
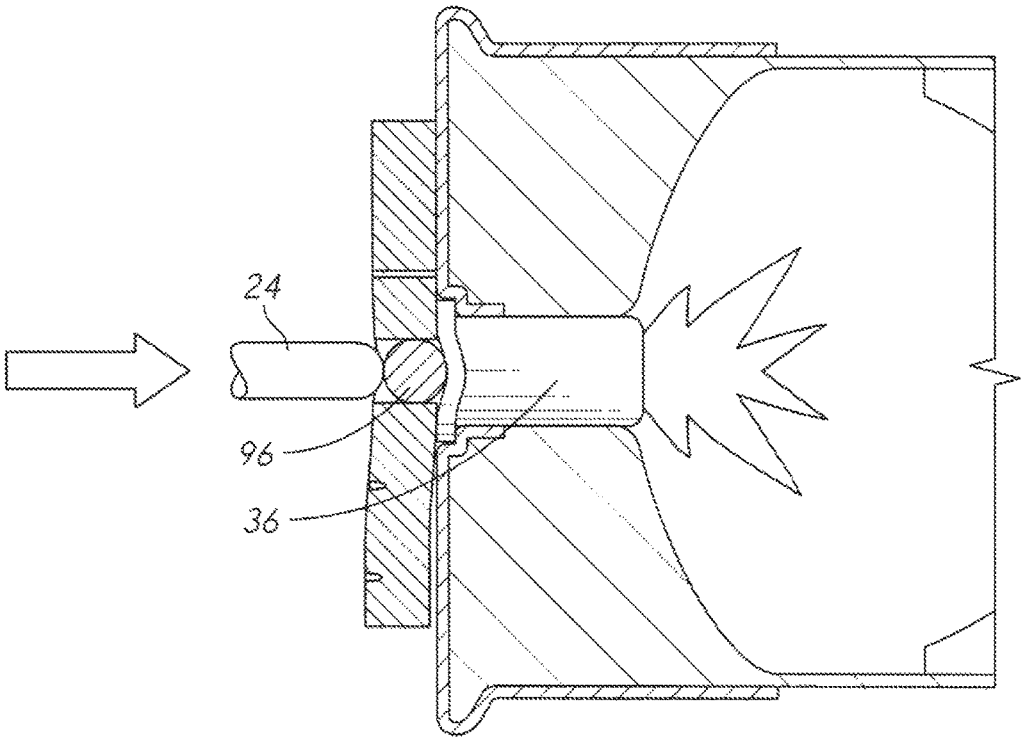
FIG. 10 is a sectional elevation view, showing the detonation of the inventive shotgun shell.

FIG. 9 shows a section view through the inventive cartridge (in this case a shotgun shell) with the token disc attached. In this example the token disc is attached using a two-part adhesive. Strike ball 96 is centered on primer 36. FIG. 10 shows the firing sequence. Firing pin 24 hits strike ball 96 and the strike ball then detonates primer 36.

Those skilled in the art of firearms will be familiar with the term "headspace." Headspace generally means the distance measured from a reference datum in the firing chamber itself to the bolt face. The reference datum is the chamber feature that stops the forward motion of the cartridge, when the cartridge is pressed into the chamber. For a shotgun shell, the reference datum is the forward portion of the rim recess (against which the shotgun shell's rim comes to rest). For most centerfire rifle cartridges the reference datum is somewhere along the slope of the cartridge case neck. For belted magnum rifle cartridges the reference datum is the forward portion of the belt recess.

Proper headspace is very important to the proper and safe operation of a firearm. If the head-space is too great, the cartridge will be loose in the chamber. This phenomenon can produce a case rupture. If the headspace is too small then the bolt will not close on the cartridge. Most firearms have safety features that prevent firing if the bolt is not closed.

Mass-produced firearms have a defined headspace for each caliber. A tolerance is permitted on this headspace, but it is fairly tight. As an example, the Small Arms and Ammunition Manufacturers Institute "(SAAMI") defines the allowable headspace for a 12 gauge shotgun chamber to be between 0.0576 and 0.0716 inches (1.463 and 1.819 mm).

Therefore, a shotgun shell with a rim thickness exceeding 0.0716 inches (1.819 mm) would not permit the bolt to fully close. This is ordinarily an undesirable condition.

However, the present invention presents a cartridge that inherently requires much more headspace than a standard firearm possesses. This feature means that a standard firearm cannot properly chamber the inventive cartridge and a standard firearm cannot fire the inventive cartridge. Every cartridge possesses a "critical cartridge length" which is defined as a distance from a reference datum on the cartridge configured to coincide with the reference datum on the firing chamber (when the cartridge is chambered) to the rearward surface of the cartridge configured to lie against any part of the bolt face.

The critical cartridge length for a 12 gauge shotgun shell is the rim thickness (including a slight offset for a fillet where the rim blends into the case head). SAAMI specifies the rim thickness of a 12 gauge cartridge to lie in the range of 0.0436 to 0.0576 inches (1.107 mm to 1.463 mm).

In the preferred embodiments of the present invention, the token disc is made thick enough so that the critical cartridge length becomes much too large for the inventive cartridge to be chambered in a conventional firearm. For example, the token disc can be given a thickness of 2.35 mm. Once such a disc is applied to the base of a 12 gauge cartridge, the critical cartridge length will lie between 2.457 and 2.813 mm. The token disc thickness is preferably at least 2 mm and even more preferably at least 2.3 mm. This substantial increase in critical cartridge length makes it impossible to fire the inventive cartridge in a conventional firearm.

Figure 11:
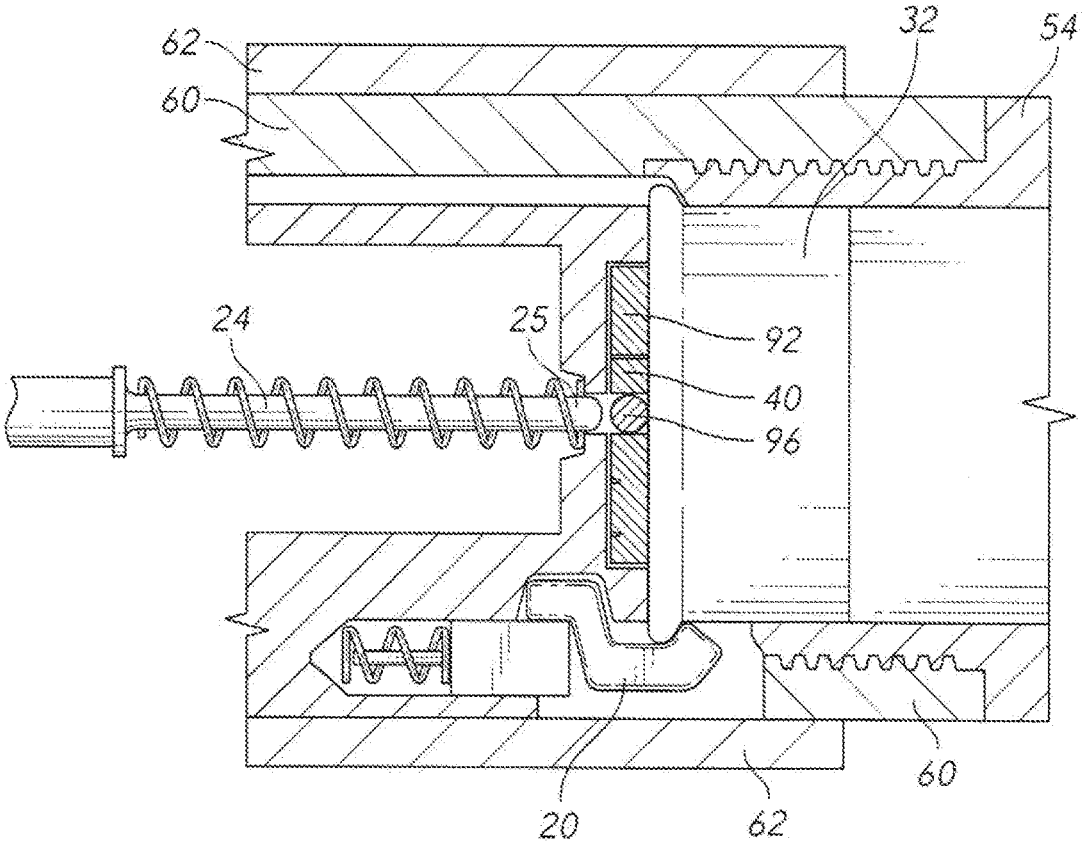
FIG. 11 is a sectional plan view, showing the inventive shotgun shell chambered in a modified shotgun.

FIG. 11 shows a sectional plan view (looking from the top down) of the inventive cartridge 32 loaded into a pomp shotgun in which the breech bolt has been modified by providing a recessed, bolt face 90. The depth of the recessed bolt face is sufficient to accommodate the thickness of the token disc and the adhesive that is used to attach it. If a disc thickness of 2.3.5 mm is used, then the recess is preferably 2.40 mm deep. Thus—as shown in FIG. 11—the modified bolt can close even though token disc 92 is present.

As explained previously, nose 25 of firing pin 24 has been shortened to the position shown. The firing pin is preferably shortened by 2.0 to 2.5 mm for a disc thickness of 2.35 mm. When the firing pin shown in FIG. 11 is struck by the firearm's hammer, it will be propelled forward (to the right in the view) and the nose of the firing pin will strike the strike ball—driving the strike ball into the primer and detonating the inventive cartridge.

The thickness of the token disc should be selected so that the critical cartridge length is substantially greater than the maximum headspace allowable for a conventional firearm of the caliber in question. In this context, the phrase "substantially beyond" means more than 1.0 mm and preferably more than 1.5 mm.

The other components of the shotgun shown are conventional. The firearm is again a Remington Model 870. A shotgun shell—modified as shown in FIG. 6—is chambered within the firing chamber in barrel 54. Shotgun shells are located longitudinally by the forward face of the shell's rim mating against the rearward-facing surface of a counterbore at the very rear of the firing chamber (The counterbore is commonly known as a "rim relief"). In the Model 870 design barrel 54 threads into barrel extension 60 as shown. Barrel extension 60 is connected to receiver 62. Breech bolt 10 cycles within receiver 62 (cycles from right to left and back again, with respect to the vantage point shown in the view).

Figure 12:
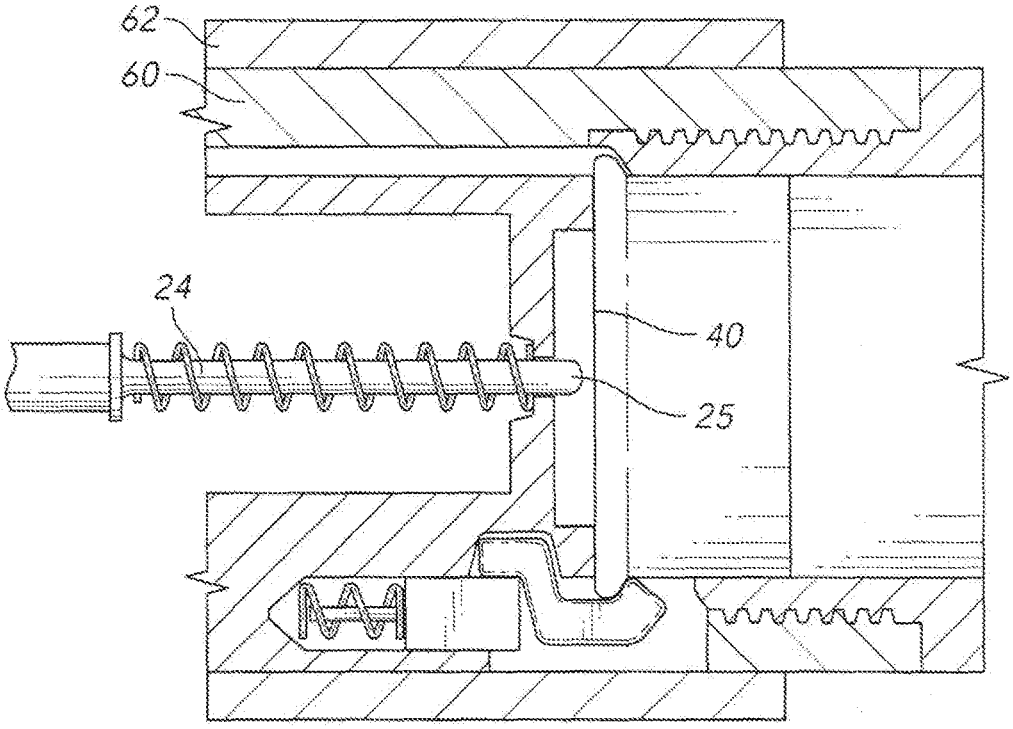
FIG. 12 is a sectional plan view, showing the modified shotgun of FIG. 11 with a conventional shotgun shell loaded.

FIG. 12 shows a sectional view through the same modified firearm with a conventional shotgun shell chambered and ready to fire. In FIG. 12, the hammer has struck, the rear of firing pin 24 and propelled it forward to its maximum extent of forward travel. Nose 25 stops short of base 40 and is then urged back to its rest position by the compression spring. Thus, the firearm modified with the bolt face relief and the shortened firing pin cannot fire a conventional shotgun shell.

The reader will thereby understand and appreciate the following: (1) An inventive shotgun shell modified with the addition of the token disc cannot be fired in a conventional firearm because the bolt of the conventional firearm cannot close on the inventive shotgun shell; and (2) A firearm modified by the addition of the bolt face relief and the shortened firing pin cannot fire a conventional shotgun shell.

Figure 13:
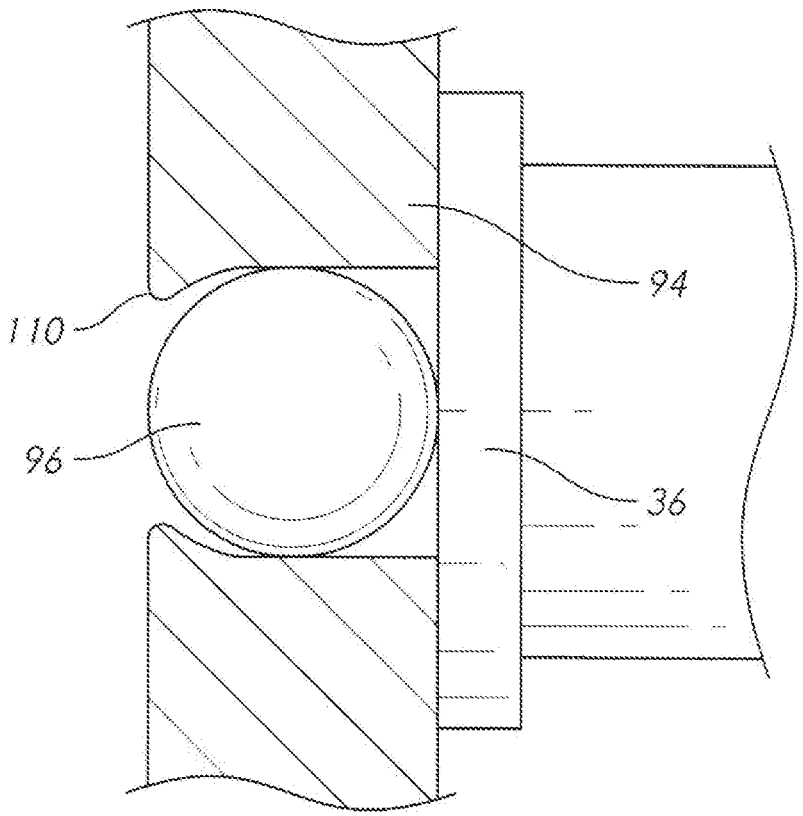
FIG. 13 is a detailed sectional elevation view, showing the strike ball.

It is of course preferable for the inventive cartridge to possess the same safety features as a conventional cartridge. In a conventional cartridge, the primer is recessed somewhat into the base so that the primer is unlikely to be struck if the cartridge is dropped on its base. The token disc can provide the same protection. FIG. 13 shows a detailed sectional view through strike plate 94. As explained previously, strike ball 96 is preferably a press fit into the passage through the strike plate. Overhang 110 can be provided in the rearward most portion of the strike plate (the left side in the orientation of the view). The strike ball can be pressed into the passage from the forward side of the strike plate before the token disc is affixed to the base of the conventional cartridge.

The diameter of the strike ball is made less than the thickness of the strike plate so that the rearward most extent of the strike ball is offset from the rear of the strike plate. This fact means that the strike plate protects the strike ball in the event the modified cartridge is dropped on its base. Overhang 110 may be created by a swaging operation when a metallic material is used for the token disc. Where a plastic material is used for the token disc the overhang can be formed as part of a molding operation. The reader should bear in mind that the overhang is an optional feature. If a straight passage is used through the token disc the press-fitting of the strike ball into place can be sufficient to retain the strike ball in a recessed position.

Figure 14:
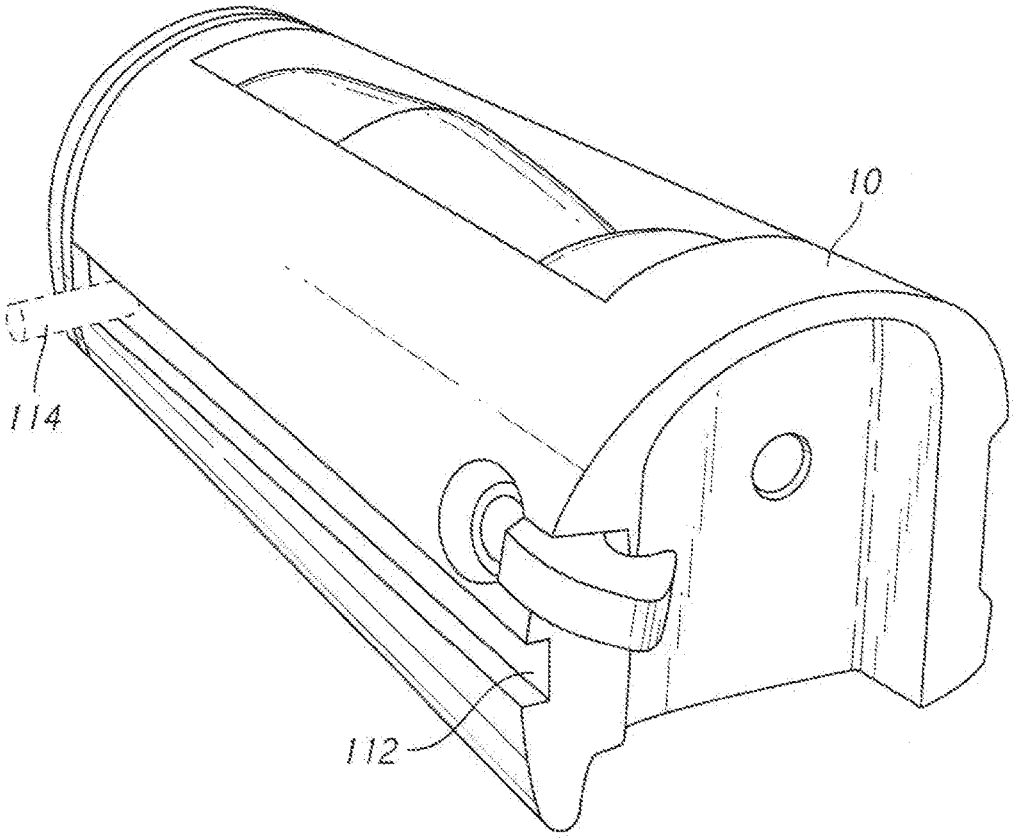
FIG. 14 is an alternate embodiment including a slot along the side of a shotgun bolt and a corresponding receiver pin mounted in a shotgun receiver.

The reader will recall that the use of the inventive cartridge requires both the inventive (modified) cartridge and a modified firearm (including a recessed bolt face). Those skilled in the art will realize that it is possible to easily change the breech bolt in many types of firearms. In the Remington 870 pump shotgun, for example, it is possible to disassemble the firearm and swap the breech bolt in a matter of minutes. There is therefore the concern that an operator might swap the breech bolt in a modified firearm and thereby equip it to fire a conventional cartridge without the token disc. FIG. 14 depicts an additional modification intended to address this concern.

In the embodiment of FIG. 14, slot 112 has been added to the right side of breech bolt 10. A corresponding receiver pin 114 (shown in dashed lines) is added to the right side of the shotgun's receiver. The receiver pin rests within the slot in the breech bolt. If a user attempts to add a conventional breech bolt, the receiver pin will interfere with the breech bolt and prevent the assembly of the weapon (the bolt being conventionally introduced by sliding it rearward into the forward part of the receiver).

The preceding description contains significant detail regarding the novel aspects of the present invention. It should not be construed, however, as limiting the scope of the invention but rather as providing illustrations of the preferred embodiments of the invention. Accordingly, the scope of the invention should be determined by reference to the claims ultimately presented rather than the examples given.

Having described my invention, I claim:

1. A cartridge configured for use in a centerfire firearm having a defined maximum headspace, comprising:

a. a base with a centrally located primer;

b. a token disc affixed to said base of said cartridge, said token disc including, i. an outer section, ii. a central strike plate separated from said outer section by a cutout, iii. an arm linking said central strike plate to said outer section, iv. a strike ball mounted in said central strike plate, with said strike ball lying proximate said centrally located primer; and c. wherein a thickness of said token disc is configured to produce a critical cartridge length for said cartridge that is substantially beyond said defined maximum headspace.

2. The cartridge as recited in claim 1, wherein said outer section, said arm, and said strike plate are made as an integral piece from one material.

3. The cartridge as recited in claim 2, wherein:

a. said strike plate is separated from said arm by a first hinge relief; and b. said arm is separated from said outer section by a second hinge relief.

4. The cartridge as recited in claim 3, wherein:

a. said strike plate includes a passage; and b. said strike ball is pressed into said passage.

5. The cartridge as recited in claim 3, wherein:

a. said strike plate includes a passage: and b. said strike ball is pressed into said passage.

6. The cartridge as recited in claim 2, wherein said strike ball is made of a hard metal.

7. The cartridge as recited in claim 6, wherein said outer section, said arm, and said strike plate are made from a material selected from the group consisting of brass, aluminum, and plastic.

8. The cartridge as recited in claim 2, wherein:

a. said strike plate includes a passage; and b. said strike ball is pressed into said passage.

9. The cartridge as recited in claim 1, wherein:

a. said strike plate includes a rearward surface; and b. said rearward surface of said strike plate lies to the rear of a rearward most extent of said strike ball.

10. The cartridge as recited in claim 1, wherein said outer section has a thickness greater than 2.0 mm.

11. The cartridge as recited in claim 1, wherein said outer section has a thickness greater than 2.3 mm.

12. A cartridge configured for use in a centerfire firearm having a defined maximum headspace, comprising:

a. a base with a centrally located primer;

b. a token disc affixed to said base of said cartridge, said token disc including a strike ball mounted in a central strike plate, with said strike ball being centered on said centrally located primer; and c. wherein a thickness of said token disc is configured to produce a critical cartridge length for said cartridge that is substantially beyond said defined maximum headspace.

13. The cartridge as recited in claim 12, wherein said token disc includes:

a. an outer section;

b. a central strike plate separated from said outer section by a cutout;

c. an arm linking said central strike plate to said outer section; and d. wherein said strike ball is mounted in said central strike plate.

14. The cartridge as recited in claim 13, wherein:

a. said strike plate is separated from said arm by a first hinge relief; and b. said arm is separated from said outer section by a second hinge relief.

15. The cartridge as recited in claim 13, wherein said outer section, said arm, and said strike plate are made from a material selected from the group consisting of brass, aluminum, and plastic.

16. The cartridge as recited in claim 13, wherein:

a. said strike plate includes a passage; and b. said strike ball is pressed into said passage.

17. The cartridge as recited in claim 13, wherein:

a. said strike plate includes a rearward surface; and b. said rearward surface of said strike plate lies to the rear of a rearward most extent of said strike ball.

18. The cartridge as recited in claim 12, wherein said strike ball is made of a hard metal.

19. The cartridge as recited in claim 12, wherein said token disc has a thickness greater than 2.0 mm.

20. The cartridge as recited in claim 12, wherein said token disc has a thickness greater than 2.3 mm.

* * * * *